US010495326B2

(12) United States Patent
Lu et al.

(10) Patent No.: US 10,495,326 B2
(45) Date of Patent: Dec. 3, 2019

(54) HEAT EXCHANGER, HEAT EXCHANGE MODULE, HEAT EXCHANGE DEVICE, AND HEAT SOURCE UNIT

(71) Applicant: DANFOSS MICRO CHANNEL HEAT EXCHANGER (JIAXING) CO., LTD., Zhejiang (CN)

(72) Inventors: Xiangxun Lu, Zhejiang (CN); Jing Yang, Zhejiang (CN); Hongbing Chen, Zhejiang (CN)

(73) Assignee: Danfoss Micro Channel Heat Exchanger (Jiaxing) Co., Ltd., Zhejiang (CN)

( * ) Notice: Subject to any disclaimer, the term of this patent is extended or adjusted under 35 U.S.C. 154(b) by 368 days.

(21) Appl. No.: 15/323,988

(22) PCT Filed: Oct. 28, 2015

(86) PCT No.: PCT/CN2015/093042

§ 371 (c)(1),
(2) Date: Jan. 5, 2017

(87) PCT Pub. No.: WO2016/091021

PCT Pub. Date: Jun. 16, 2016

(65) Prior Publication Data

US 2017/0205085 A1 Jul. 20, 2017

(30) Foreign Application Priority Data

Dec. 11, 2014 (CN) ..... 2014 2 0783711 U

(51) Int. Cl.
*F28D 1/047* (2006.01)
*F24F 1/18* (2011.01)
(Continued)

(52) U.S. Cl.
CPC ..... *F24F 1/18* (2013.01); *F28D 1/0435* (2013.01); *F28D 1/0471* (2013.01); *F28F 1/02* (2013.01);
(Continued)

(58) Field of Classification Search
CPC .... F28D 1/0426; F28D 1/0435; F28D 1/0471; F28D 1/047; F28D 1/0475; F28D 1/0443;
(Continued)

(56) References Cited

U.S. PATENT DOCUMENTS 4,261,418 A * 4/1981 Helt ..... F24F 1/50 165/134.1
2006/0086488 A1 4/2006 Heng-I et al.
(Continued)

FOREIGN PATENT DOCUMENTS

CN 102472536 A 5/2012
CN 103925742 A 7/2014
(Continued)

OTHER PUBLICATIONS

Supplementary European Search Report for Serial No. EP 15 86 6545 dated Jun. 12, 2018.
(Continued)

*Primary Examiner* — Christopher R Zerphey
*Assistant Examiner* — For K Ling
(74) *Attorney, Agent, or Firm* — McCormick, Paulding & Huber LLP

(57) ABSTRACT

A heat exchanger (1, 2, 10, 20) of a heat exchange device, a heat exchange module (100), a heat exchange device (65, 75, 115) and a heat source unit used for an air-cooling cold-water unit or a commercial roof machine. The heat exchanger (1, 2, 10, 20) comprises: a main body (15, 65, 75, 115) having a substantially quadrilateral side surface; bent parts (16, 17, 66, 67, 76, 77, 116, 117) connected to the main
(Continued)

body (15, 65, 75, 115), and at least one of bent parts (17, 67, 77, 117) having a substantially quadrilateral side surface; when there being two bent parts (16, 17, 66, 67, 76, 77, 116, 117), one bent part (17, 67, 77, 117) having a substantially quadrilateral side surface, and the other having a substantially trapezoidal side surface; at least one heat exchange tube (13) extending between the main body (15, 65, 75, 115) and the bent part (16, 17, 66, 67, 76, 77, 116, 117), and the heat exchange tube (13) in the bent part (16, 17, 66, 67, 76, 77, 116, 117) being inclined and bent relative to the heat exchange tube (13) in the main body part (15, 65, 75, 115), so that the plane in which the main body (15, 65, 75, 115) lies being perpendicular or substantially perpendicular to the plane in which each of two bent parts (16, 17, 66, 67, 76, 77, 116, 117) lies. The heat exchanger (1, 2, 10, 20), the heat exchange module (100), the heat exchange device (65, 75, 115) and the heat source unit can effectively utilize the space between the heat exchanger (1, 2, 10, 20).

24 Claims, 6 Drawing Sheets

(51) Int. Cl.

| | |
|---|---|
| ***F28F 1/22*** | (2006.01) |
| ***F28D 1/04*** | (2006.01) |
| ***F28F 1/02*** | (2006.01) |
| ***F28F 9/02*** | (2006.01) |
| *F28D 1/02* | (2006.01) |

(52) U.S. Cl.
CPC ..... *F28F 1/22* (2013.01); *F28F 9/0243* (2013.01); *F24F 2221/16* (2013.01); *F28D 2001/0266* (2013.01); *F28D 2001/0273* (2013.01)

(58) Field of Classification Search
CPC ..... F28D 2001/0273; F28D 2001/0073; F28D 2001/0266; F24F 1/18; F24F 1/16; F24F 1/14; F24F 1/06; F24F 1/22; F24F 1/48; F24F 1/500059; F24F 1/0067; F24F 1/0063; F24F 1/0007; F24F 13/30; B21D 53/085
See application file for complete search history.

(56) References Cited

U.S. PATENT DOCUMENTS

| | | | | |
|---|---|---|---|---|
| 2007/0204978 | A1* | 9/2007 | Beamer | F28D 1/05366 165/124 |
| 2009/0084131 | A1 | 4/2009 | Reifel et al. | |
| 2010/0162739 | A1* | 7/2010 | Kopko | F24F 1/16 62/115 |
| 2011/0094257 | A1 | 4/2011 | Rusignuolo et al. | |
| 2012/0125033 | A1* | 5/2012 | Tanno | F24F 3/06 62/324.1 |
| 2012/0227731 | A1* | 9/2012 | Tamaura | G02B 19/0042 126/664 |

FOREIGN PATENT DOCUMENTS

| | | | |
|---|---|---|---|
| CN | 204329670 | U | 5/2015 |
| JP | 2004144429 | A | 5/2004 |
| JP | 2004-340504 | A | 12/2004 |
| WO | 2011/013672 | A1 | 2/2011 |
| WO | 2011/034633 | A1 | 3/2011 |

OTHER PUBLICATIONS

International Search Report for PCT Serial No. PCT/CN2015/093042 dated Jan. 7, 2016.

* cited by examiner

HEAT EXCHANGER, HEAT EXCHANGE MODULE, HEAT EXCHANGE DEVICE, AND HEAT SOURCE UNIT

CROSS-REFERENCE TO RELATED APPLICATION

This application is entitled to the benefit of and incorporates by reference subject matter disclosed in the International Patent Application No. PCT/CN2015/093042 filed on Oct. 28, 2015 and Chinese Patent Application No. 201420783711.6 filed on Dec. 11, 2014.

TECHNICAL FIELD

The present invention relates to the fields of heating, ventilation and air conditioning, motor vehicles, refrigeration and transportation, and in particular relates to a heat exchanger, heat exchange module, heat exchange device and heat source unit for an evaporator, condenser or water tank, etc.

BACKGROUND

The prior art document WO2011013672 has disclosed a heat source unit. Specifically, the heat source unit is provided with air heat exchangers, each air heat exchanger comprising multiple heat-dissipating fins arranged at regular intervals, heat exchange tubes passing through the heat-dissipating fins, bent plate parts which extend at two sides and are bent in the same direction, and a heat exchange module. Each heat exchange module comprises two air heat exchangers, each air heat exchanger having a bent part disposed opposite a bent part of another air heat exchanger. The air heat exchanger is inclined, such that bottom edges are close to each other but top edges are spaced apart; thus the heat exchange module is substantially V-shaped in a side view drawing.

However, edges of heat exchangers at left and right sides in the heat source unit are spaced apart in an upper part of the V-shaped structure. Thus, a shrouding plate (or metal plate) is still needed to connect two heat exchangers, and as a result, the space between two heat exchangers is not effectively used.

Ever higher requirements are being placed on the energy efficiency of heating, ventilation and air conditioning systems (HVAC systems), so there is an ever increasing need for heat exchangers of higher performance. At present, the only option in the prior art is to manufacture larger heat exchangers and air conditioning systems, and this increases the costs of manufacture and installation.

In view of the above, there is definitely a need to provide a novel heat exchanger, heat exchange module, heat exchange device and heat source unit which are capable of at least partially solving the abovementioned problems.

SUMMARY

The object of the present invention is to solve at least one aspect of the abovementioned problems and defects in the prior art.

In one aspect of the present invention, a heat exchanger of a heat exchange device for use on an air-cooled water chiller unit or commercial rooftop machine is provided, the heat exchanger comprising:

a main body part, having a substantially quadrilateral side;

at least one bent part connected to the main body part, with one of the at least one bent part having a substantially parallelogram-shaped side;

at least one heat exchange tube, extending between the main body part and the bent part, wherein a heat exchange tube in the bent part is inclined and bent relative to a heat exchange tube in the main body part, such that the plane in which the main body part lies is perpendicular or substantially perpendicular to the plane in which the bent part lies.

Preferably, the at least one bent part is two bent parts, one of the two bent parts having a substantially parallelogram-shaped side, and the other bent part having a substantially trapezoidal side.

Preferably, two sides of the heat exchange tube are each bent at an angle $\alpha$ using a width direction as an axis, with a bending point on each side of the heat exchange tube lying substantially on a first bending axis, and the heat exchange tube being bent at an angle $\beta$ along the first bending axis, wherein $\beta$ is the included angle between two non-parallel sides of a trapezoidal side, the angle $\alpha$ is in the range of $\beta/2-5°$ to $\beta/2+5°$, and when a short edge of the trapezoidal side is located at the bottom, the length of each heat exchange tube increases incrementally by $2L*\tan(\alpha)$ from bottom to top, wherein the distance between heat exchange tubes in the bent part is L.

Preferably, the at least one bent part is two bent parts which both have a substantially parallelogram-shaped side.

Preferably, two sides of the heat exchange tube are each bent using a width direction as an axis, with a bending point on each side of the heat exchange tube lying substantially on a first bending axis, and the heat exchange tube being bent along the first bending axis.

Preferably, the at least one bent part is only one bent part, and the bent part has a substantially parallelogram-shaped side.

Preferably, one side of the heat exchange tube is bent using a width direction as an axis, with a bending point on this side of the heat exchange tube lying substantially on a first bending axis, and the heat exchange tube being bent along the first bending axis.

In another aspect of the present invention, a heat exchanger of a heat exchange device for use on an air-cooled water chiller unit or commercial rooftop machine is provided, the heat exchanger comprising:

a main body part, having a substantially quadrilateral side;

two bent parts connected to the main body part, each of the two bent parts having a substantially trapezoidal side;

at least one heat exchange tube, extending between the main body part and the bent parts, wherein a heat exchange tube in the bent part is inclined and bent relative to a heat exchange tube in the main body part, such that the plane in which the main body part lies is perpendicular or substantially perpendicular to the plane in which each of the two bent parts lies.

Preferably, two sides of the heat exchange tube are each bent at an angle $\alpha$ using a width direction as an axis, with a bending point on each side of the heat exchange tube lying substantially on a first bending axis, and the heat exchange tube being bent at an angle $\beta$ along the first bending axis.

$\beta$ is the included angle between two non-parallel sides of a trapezoidal side, the angle $\alpha$ is in the range of $\beta/2-5°$ to $\beta/2+5°$, and when a short edge of the trapezoidal side is located at the bottom, the length of each heat exchange tube increases incrementally by $4L*\tan(\alpha)$ from bottom to top, wherein the distance between heat exchange tubes in the bent part is L.

In another aspect of the present invention, a heat exchanger of a heat exchange device for use on an air-cooled water chiller unit or commercial rooftop machine is provided, the heat exchanger comprising:

a main body part;

at least one bent part connected to the main body part, the at least one bent part being only one bent part, and the bent part having a bent trapezoidal side;

at least one heat exchange tube, extending between the main body part and the bent part, wherein a heat exchange tube in the bent part is inclined and bent relative to a heat exchange tube in the main body part, such that the plane in which the main body part lies is perpendicular or substantially perpendicular to the plane in which the bent part lies.

Preferably, one side of the heat exchange tube is bent at an angle $\alpha$ using a width direction as an axis, with a bending point on this side of the heat exchange tube lying substantially on a first bending axis;

the bent heat exchange tube is bent at an angle $\beta$ along a second bending axis that is different from the first bending axis, wherein $\beta$ is the included angle between two non-parallel sides of a trapezoidal side, the angle $\alpha$ is in the range of $\beta/2-5°$ to $\beta/2+5°$, and when a short edge of the trapezoidal side is located at the bottom, the length of each heat exchange tube increases incrementally by $2L*\tan(\alpha)$ from bottom to top, wherein the distance between heat exchange tubes in the bent part is L.

Preferably, the distance between the first bending axis and second bending axis is less than or equal to 200 mm.

Preferably, also included are two headers disposed on two opposite sides of the heat exchanger, wherein the heat exchange tube is multiple heat exchange tubes, which are arranged at intervals in the main body part and bent part and extend substantially parallel to each other in the main body part and bent part;

each of the heat exchange tubes extends from one of the two headers to the other header through the bent part and main body part.

Preferably, the heat exchange tubes are flat tubes, and fins are disposed on those parts of the flat tubes which are not bending points, with ends of the flat tubes being in perpendicular communication with the headers.

In another aspect of the present invention, a heat exchange module of a heat exchange device for use on an air-cooled water chiller unit or commercial rooftop machine is provided, the heat exchange device comprising at least one heat exchange module, each heat exchange module comprising two identical and matching heat exchangers which are joined together, each heat exchanger being a heat exchanger described above.

In another aspect of the present invention, a heat exchange module of a heat exchange device for use on an air-cooled water chiller unit or commercial rooftop machine is provided, the heat exchange device comprising at least one heat exchange module comprising two heat exchangers which are joined together; each heat exchange module comprises two different but matching heat exchangers, one of these heat exchangers being a heat exchanger described above, and the other of these heat exchangers being a heat exchanger described above.

In another aspect of the present invention, a heat exchange module of a heat exchange device for use on an air-cooled water chiller unit or commercial rooftop machine is provided, the heat exchange device comprising at least one heat exchange module comprising two heat exchangers which are joined together; each heat exchange module comprises two different but matching heat exchangers, one of these two heat exchangers being a heat exchanger described above, and the other of these two heat exchangers only having a main body part having a substantially parallelogram-shaped side.

Preferably, an air leakage region formed when the two heat exchangers are joined together is provided with an air baffle plate.

In another aspect of the present invention, a heat exchange module of a heat exchange device for use on an air-cooled water chiller unit or commercial rooftop machine is provided, the heat exchange device comprising at least one heat exchange module comprising two heat exchangers which are joined together; each heat exchange module comprises two identical and matching heat exchangers, each of these two heat exchangers being a heat exchanger described above.

Preferably, an air leakage region formed when the two heat exchangers are joined together is provided with an air baffle plate.

In another aspect of the present invention, a heat exchange module of a heat exchange device for use on an air-cooled water chiller unit or commercial rooftop machine is provided, the heat exchange device comprising at least one heat exchange module comprising two heat exchangers which are joined together; each heat exchange module comprises two identical and matching heat exchangers, each of these two heat exchangers being a heat exchanger described above.

Preferably, an air leakage region formed when the two heat exchangers are joined together is provided with an air baffle plate.

In another aspect of the present invention, a heat exchange module of a heat exchange device for use on an air-cooled water chiller unit or commercial rooftop machine is provided, the heat exchange device comprising at least one heat exchange module comprising four heat exchangers joined together;

two of the four heat exchangers have the same dimensions and substantially quadrilateral sides, the other two of the four heat exchangers have the same dimensions and trapezoidal sides, each heat exchanger comprises two headers disposed on two opposite sides of the heat exchanger, multiple heat exchange tubes are in communication with the headers, and are arranged at intervals in the sides of the heat exchangers, extending substantially parallel to each other therein.

Preferably, the heat exchange tubes are flat tubes, on which are provided fins.

In another aspect of the present invention, a heat exchange device for use on an air-cooled water chiller unit or commercial rooftop machine is provided, the heat exchange device comprising at least one heat exchange module which is a heat exchange module described above.

In another aspect of the present invention, a heat source unit is provided, the heat source unit also comprising, in cooperation with each other, a heat exchange device, a blower, a water drainage plate in communication with the heat exchange device, and a machine room which houses cooling cycle constituent parts other than the heat exchange device; the heat exchange device is a heat exchange device described above.

BRIEF DESCRIPTION OF THE DRAWINGS

These and/or other aspects and advantages of the present invention will be made clear and easy to understand by the following description of preferred embodiments in conjunction with the accompanying drawings, wherein.

DETAILED DESCRIPTION

Figure 1:
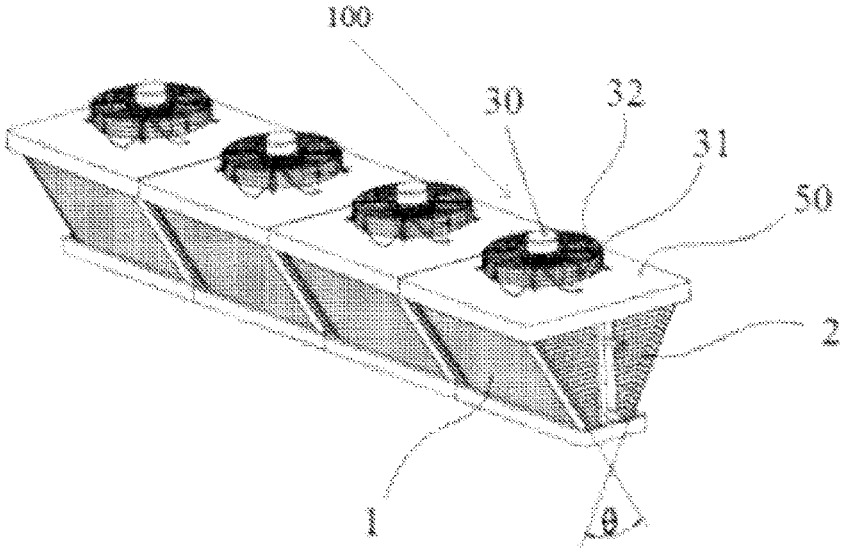
FIG. 1 is a schematic diagram of a heat exchange device according to the present invention.

The technical solution of the present invention is explained in further detail below by means of embodiments, in conjunction with FIGS. 1-11. In this description, identical or similar drawing labels indicate identical or similar components. The following explanation of embodiments of the present invention with reference to the accompanying drawings is intended to explain the overall inventive concept of the present invention, and should not be interpreted as a limitation of the present invention.

As will be understood from the background art of the present invention, the key design point of the present invention lies in improvement of the heat exchange module used in the heat source unit in the document WO 2011013672. Specifically, since the pair of heat exchangers in that document are arranged in a substantially V-shaped form in a side view drawing, a substantially V-shaped space will be formed between bent parts of opposing air heat exchangers. Clearly, in the aforesaid document, the space between main body parts of the pair of heat exchangers that have been fitted together, and the space between their adjacent bent parts, both substantially form the same V-shape, in other words the included angles between them are the same, and are generally in the range of 30-90°. The final result is that the V-shaped space between the pair of heat exchangers is not used effectively. Since the included angle between them is large, the V-shaped space must be closed by a plate body that has been cut into a substantially V-shaped form, i.e. a shrouding plate, to prevent air or wind from passing through the V-shaped space and thereby affecting the heat exchange effect.

In the present invention, a heat exchanger, heat exchange module, heat exchange device and heat source unit are provided, which successfully resolve the shortcomings mentioned in the aforesaid document at least partially. Thus, the description below will focus on ways in which the present invention improves the heat exchanger, heat exchange module, heat exchange device and heat source unit. The arrangement of components in the heat source unit mentioned in the aforesaid document (such as a blower, a water drainage plate in communication with the heat exchange device, and a machine room which houses cooling cycle constituent parts other than the heat exchange device) may also be applied in the present invention, and therefore the aforesaid document may be referred to for a specific description of those components, which are not described in detail again here.

It is clear from the aforesaid document that a conventional heat exchanger is generally rectangular, and requires a sheet metal element to close the V-shaped side. It must be explained here that although it is referred to as a V-shaped side in the aforesaid document, in actual manufacturing processes it is generally manufactured to have a substantially trapezoidal shape, as can be seen from the accompanying drawings of the present invention and the aforesaid document. Therefore, in the present invention it is referred to as a trapezoidal side, so as to better conform to the actual situation. The object of the present invention is to increase the heat exchange area, to meet different application and installation requirements. It can be seen from the following that in the present invention, the trapezoidal sides closed by sheet metal elements are at least partially replaced by bending the heat exchangers such that after being joined together, the sides of the heat exchange module form a trapezoidal or substantially trapezoidal shape.

The heat exchanger, heat exchange module, heat exchange device and heat source unit according to an embodiment of the present invention may be applied to a commercial air conditioning system, specifically used in a heat source unit, an air-cooled water chiller unit or a commercial rooftop machine. In general, the heat exchange device comprises at least one heat exchange module, which has at least one substantially trapezoidal side (abbreviated as trapezoidal heat exchange side part hereinbelow) perpendicular to left and right sides, wherein a header and heat exchange tubes and/or fins thereon are provided in a heat exchange side.

Those skilled in the art will understand that when the heat exchange device has multiple heat exchange modules 100, the heat exchange device may be formed of multiple heat exchange modules 100 of the same type, or employ any combination of heat exchange modules 100 of different types according to the present invention, as required.

Referring to FIG. 1, a top end of the heat exchange module 100 is provided with a top plate 50, and a blower module or unit 30 is provided on the top plate 50 in a position corresponding to the heat exchangers 1 and 2. In one embodiment, a cylindrical wind outlet 31 is provided in a direction of upward protrusion from the top plate 50, and a fan shroud 32 covers a protruding end face of the wind outlet 31. The blower 30 comprises: a propeller-type fan, accommodated in the wind outlet 31; a shaft core, mounted in opposition to the fan shroud 32, and a fan motor, with the propeller-type fan being mounted on a rotation shaft.

Of course, in order to fix the heat exchange module 100 in place better, the bottom of the heat exchange module 100 may also be provided with a supporting element or supporting frame (not shown) which fixes it in place. In practice, as FIG. 1 shows, the left and right sides of the heat exchange module 100 are not V-shaped sides in a strict sense, but trapezoidal sides in practical applications. As shown in the figure, each heat exchange module 100 has, on both the left and the right side in the plane of the page, a trapezoidal heat exchange side with an included angle θ between two non-parallel edges.

Here, to facilitate description and explanation, only a heat exchange part or heat exchanger/heat exchange unit contained therein is shown.

Figure 2:
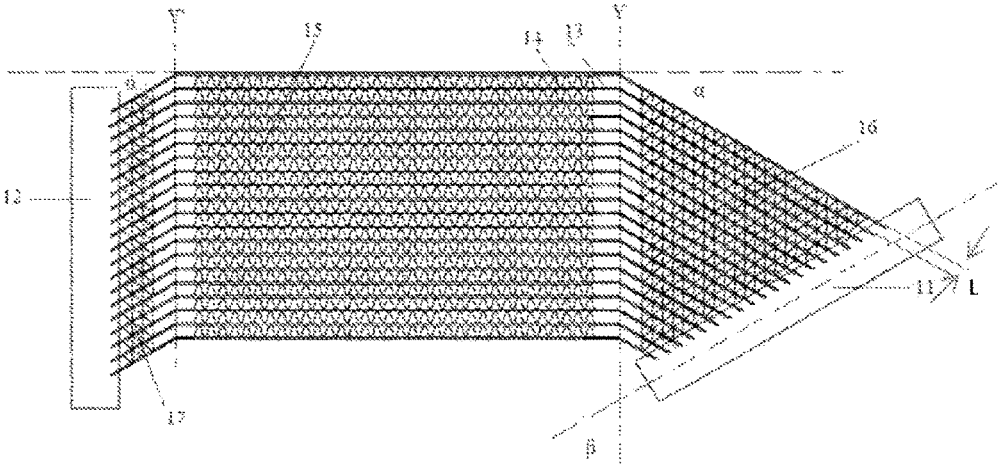
FIG. 2 is a schematic diagram of a heat exchanger according to a first embodiment of the present invention.
Figure 3:
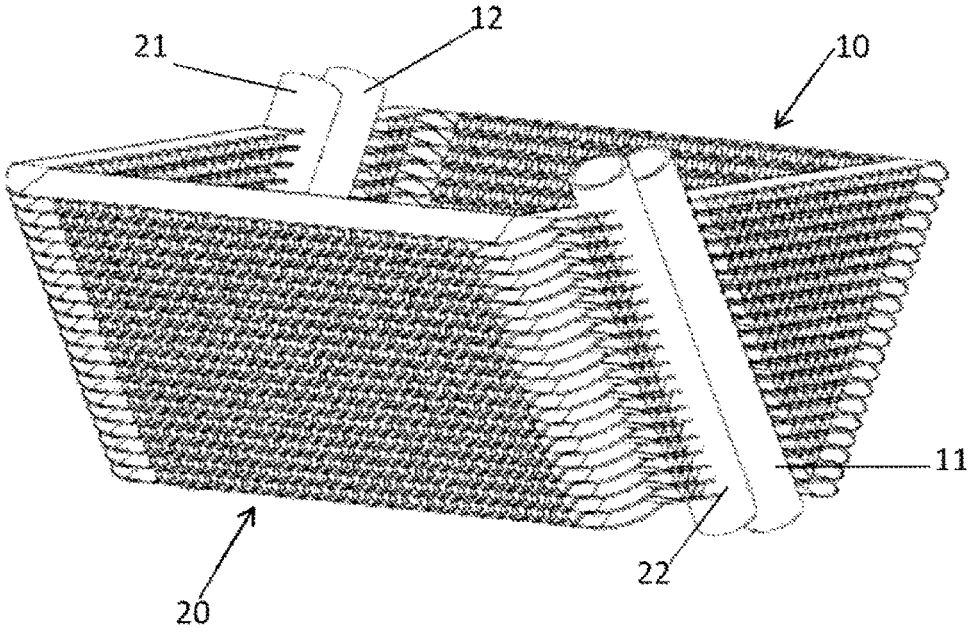
FIG. 3 is a schematic diagram of a heat exchange module according to the first embodiment of the present invention, comprising the heat exchanger shown in FIG. 2.

Reference is made to FIGS. 2-3, which show schematic diagrams of a heat exchanger according to a first embodiment of the present invention and a heat exchange module formed therefrom. Specifically referring to FIG. 3, the heat exchange module 100 comprises a heat exchange unit 10 and a heat exchange unit 20 which have been bent; as stated below, the heat exchange unit 10 and heat exchange unit 20 may be the same or different. Each heat exchange unit 10 or 20 may be formed of one or more heat exchangers; here, for the sake of simplicity and convenience, each heat exchange unit is drawn and described as a single heat exchanger. In a first embodiment of the present invention, the heat exchangers 10 and 20 are exactly the same.

Referring to FIG. 2, in a first embodiment of the present invention, the heat exchanger 10 comprises a header 11, a header 12, heat exchange tubes 13 and fins 14. Multiple heat exchange tubes extending horizontally in a left-right direction in the plane of the page in FIG. 2 (and the fins, if provided) form a main body part 15 of the heat exchanger 10, while multiple heat exchange tubes and fins disposed on two sides of the heat exchanger 10 at an angle α relative to the left-right direction in the plane of the page in FIG. 2 form a bent part 16 and a bent part 17. The bent part 16 has a substantially trapezoidal side, for forming part of a trapezoidal heat exchange side (which will be described below) of the heat exchange module; the bent part 17 has a substantially quadrilateral side (shown in the figure as a parallelogram), for forming part of another trapezoidal heat exchange side of the heat exchange module. The main body part 15 and bent part 16 are connected at a straight line Y, which is called a bending axis Y due to the fact that, as described below, the bent part 16 is bent outwards relative to the plane of the page in FIG. 2, using the bending axis Y as an axis. By the same principle, the main body part 15 and bent part 17 are connected at a straight line Y'; Y and Y' are called bending axes due to the fact that, as described below, the bent parts 16 and 17 are bent outwards relative to the plane of the page in FIG. 2, using the bending axes Y and Y' as axes. It must be explained that in this example, the bent parts 16 and 17 are only bent once along the bending axes Y and Y' thereof.

In the heat exchanger 10 shown in FIG. 2, the headers 11 and 12 are respectively disposed at outermost sides of the heat exchanger 10, i.e. at the right side of the bent part 16 and the left side of the bent part 17. The lengths of the header 11 and the header 12 are equal or approximately equal, but as shown in the figure, they form a certain angle or are inclined relative to one another. Multiple heat exchange tubes 13 are disposed at intervals, parallel to each other, between the header 11 and the header 12. Multiple slots for fitting the heat exchange tubes 13 are provided on the headers 11 and 12 respectively. The fins 14 are disposed between adjacent heat exchange tubes 13. In this example, the heat exchange tubes 13 are flat tubes.

Two sides of the heat exchange tubes 13 are bent at an angle α for example, using the width direction as an axis, wherein the points at which the heat exchange tubes are bent lie substantially on the bending axes Y and Y' respectively, and the angle α is in the range of β/2−5° to β/2+5°, wherein β is equal to or smaller than the included angle θ of the trapezoidal heat exchange side. By the same principle, the heat exchanger 20 may be arranged in a similar manner to the heat exchanger 10, so as to be the same as the heat exchanger 10, and is not described here.

In order to focus on describing the important points, the figure omits the related components in a water chiller unit or heat source unit associated therewith. In view of the fact that the main design of the present invention relates to the heat exchange device, such an omission will not affect the understanding of the present invention by those skilled in the art, and will not result in the disclosed content of the present invention being incomplete.

It is well known in the art that a heat exchange device comprises at least one heat exchange module. It can be understood that the heat exchange device according to the present invention may comprise one or more (e.g. two, three, five) heat exchange modules and a corresponding number of blower modules or blower units, wherein the multiple blower modules or blower units form a blower apparatus or blower system. Of course, each blower unit or module may also be one blower or a greater number of blowers.

In general, the heat exchange module comprises two heat exchangers joined together. Of course, those skilled in the art will understand that the way in which the heat exchange module is formed is not limited to the type described above; the heat exchange module may also be formed in the following ways: the heat exchange module may comprise a single heat exchange unit, with trapezoidal heat exchange sides thereof being formed by bending a part of the single heat exchange unit (e.g. bending two ends of a single flat-plate heat exchanger). Alternatively, the heat exchange module may also be formed of multiple heat exchange units, wherein the trapezoidal heat exchange side part is formed by a single heat exchange unit, the trapezoidal heat exchange side being fitted onto another part (e.g. another heat exchanger adjacent thereto) of the heat exchange module. Alternatively, the heat exchange module may also comprise one heat exchange unit and one support member (e.g. a metal plate support member) which are fitted together facing each other, with the heat exchange unit being bent to form the trapezoidal heat exchange side, and the trapezoidal heat exchange side being fitted onto the support member. In principle, each heat exchange unit is a single heat exchanger in the conventional sense, i.e. has two headers, and multiple heat exchange tubes (e.g. flat tubes, on which multiple fins may be disposed if possible) extending in parallel at intervals therebetween. Of course, multiple heat exchangers may also be included. To make the description concise, a single heat exchange unit is abbreviated as a heat exchanger below.

As shown in FIGS. 2-3, in a first embodiment of the present invention, each heat exchange module comprises two identical heat exchangers, i.e. the heat exchangers 10 and 20 are the same. In the heat exchange module, each trapezoidal heat exchange side is formed of bent parts of two heat exchangers joined together.

Specifically, the heat exchange tubes 13 in the bent parts 16 and 17 are inclined and bent relative to the heat exchange tubes in the main body part 15, such that the plane in which the main body part 15 lies is perpendicular or substantially perpendicular to the plane in which each of the two bent parts lies.

Taking FIG. 2 as an example, the method of bending the heat exchanger 10 having bent parts at two sides is explained as follows: first the flat tubes 13 are bent, then a body of the heat exchanger 10 is bent. The specific bending steps are as follows: first of all, two sides of each flat tube 13 (such as the left and right sides of the flat tube in the drawing) are bent at an angle α using the width direction of the flat tube (i.e. the front-rear direction in the plane of the page) as an axis, and the bent flat tubes 13 are then inserted into the slots (not shown) in the headers 11 and 12 in sequence. Then by adjusting the positions of the flat tubes, it is ensured that the bending points, on either side, of all the flat tubes 13 are substantially on one line, i.e. on the bending axes Y and Y' shown in FIG. 2. Thus the heat exchanger 10 forms the main body part 15 and bent parts 16 and 17. Fins 14 are inserted between adjacent flat tubes, which are then put into a brazing furnace and brazed to form a single body. Finally, the bent parts 16 and 17 in the bent heat exchanger are bent along a direction substantially perpendicular to the main body part 15 using the bending axes Y and Y' as a bending axes (i.e. the body of the heat exchanger is bent), such that the main body part 15 is perpendicular or substantially perpendicular to the bent parts 16 and 17 (see FIG. 3).

As shown in FIGS. 2 and 3, the main body part 15 is a rectangular side in the heat exchange module 100, while the bent parts 16 and 17 of the heat exchanger 10 respectively form a trapezoidal heat exchange side of the heat exchange module 100 together with two bent parts of the other heat exchanger 20. However, it can be understood that the case where the main body part 15 is of rectangular shape is just one example; it may have any suitable shape as required, for example a substantially square, trapezoidal, or parallelogram shape.

In the bent part 16, the bottommost flat tube has the shortest length, the topmost flat tube has the longest length, and the spacing between flat tubes is L. Moreover, preferably, the lengths of the flat tubes in the bent part increase incrementally by 2L tan($\alpha$) from bottom to top. For convenience of fabrication, the length of each flat tube can be adjusted slightly.

During bending, preferably, the bending angle $\alpha$ of the flat tubes is substantially half of the included angle $\beta$ between two non-parallel edges of the trapezoidal side (i.e. the bent part 16), but generally only needs to be in the range of $\beta/2-5°$ to $\beta/2+5°$. The included angle $\beta$ between the bending axis Y and the header 12 is preferably substantially equal to or smaller than an apex angle $\theta$ of the heat exchange trapezoidal side. Of course, the manner of bending described above is merely an example of the present invention; those skilled in the art could of course choose another manner of bending as required (for example perform bending at a different angle).

For convenience of assembly, that end of the flat tube 13 which is located at the header 11 or 12 may be bent so that the flat tube 13 is inserted into the slot in the header 12 perpendicularly or substantially perpendicularly. Of course, those skilled in the art may also arrange for substantially or essentially no fins to be provided at the bending points of the flat tube 13 (i.e. substantially the locations of the bending axes Y and Y'), so that it is easier to bend the heat exchanger 10, and the bending radius can be made as small as possible.

Those skilled in the art will understand that in this embodiment, since the right-side heat exchanger 10 and left-side heat exchanger 20 in the heat exchange module 100 are substantially identical or symmetric, the structure and bending principles of the heat exchanger 20 are substantially the same as the structure and principles of the heat exchanger 10, so are not described again here.

Referring to FIG. 3 again, the heat exchanger 10 and heat exchanger 20 are connected to each other by means of their respective headers, to form the heat exchange module 100. That is, the header 11 in the heat exchanger 10 is connected to a header 22 in the heat exchanger 20, and the header 12 in the heat exchanger 10 is connected to a header 21 in the heat exchanger 20, such that the bent parts of the heat exchanger 10 and the heat exchanger 20 are used as two trapezoidal heat exchange sides of the heat exchange module 100 respectively, so the heat exchange area is increased. Those skilled in the art may select a particular arrangement as required, without being limited to the arrangement described above. The above examples are merely given to provide a demonstrative explanation, and cannot be interpreted as being a limitation of the present invention.

Figure 4:
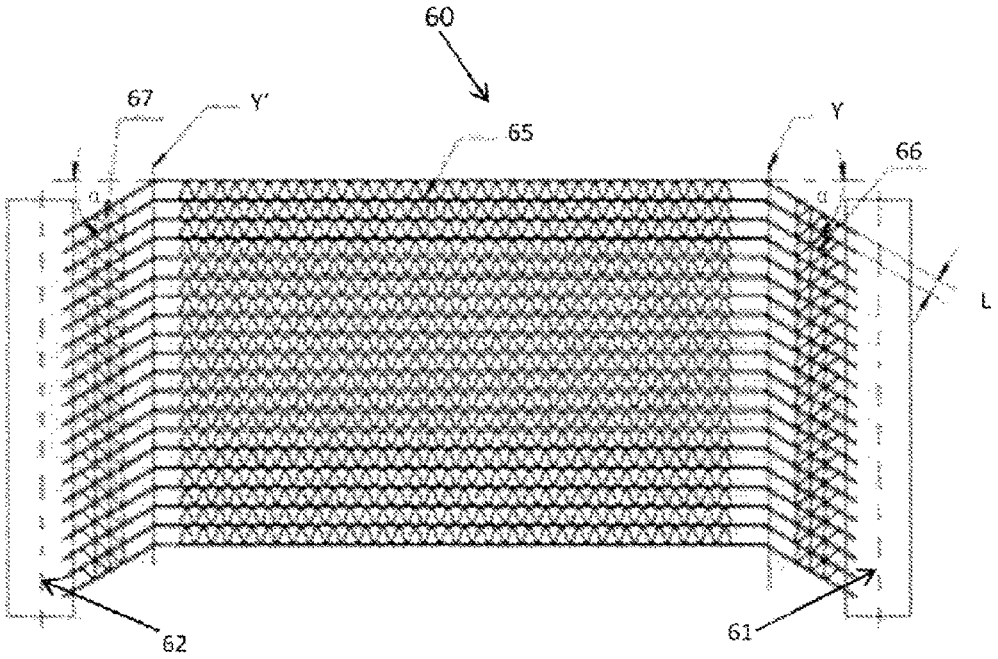
FIG. 4 is a schematic diagram of a heat exchanger according to a second embodiment of the present invention.
Figure 5:
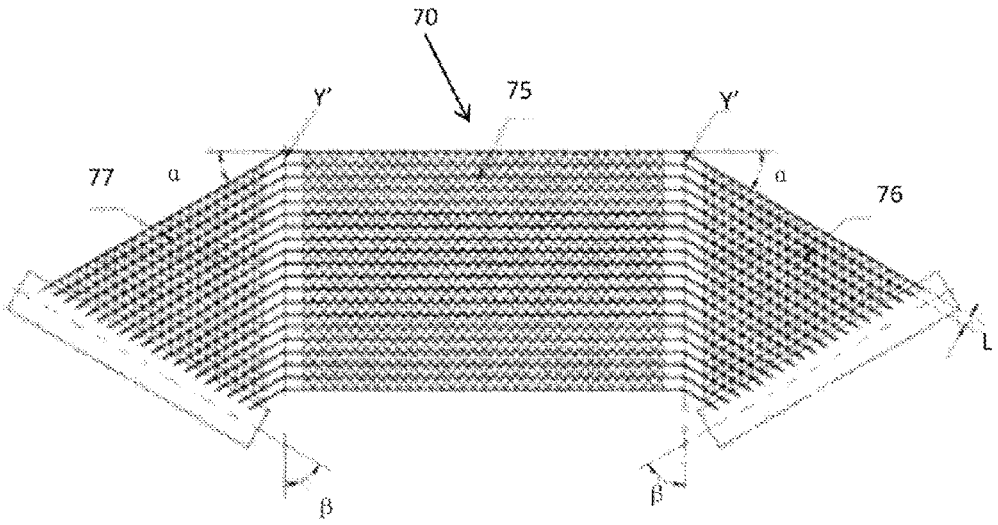
FIG. 5 is a schematic diagram of another heat exchanger according to the second embodiment of the present invention.
Figure 6:
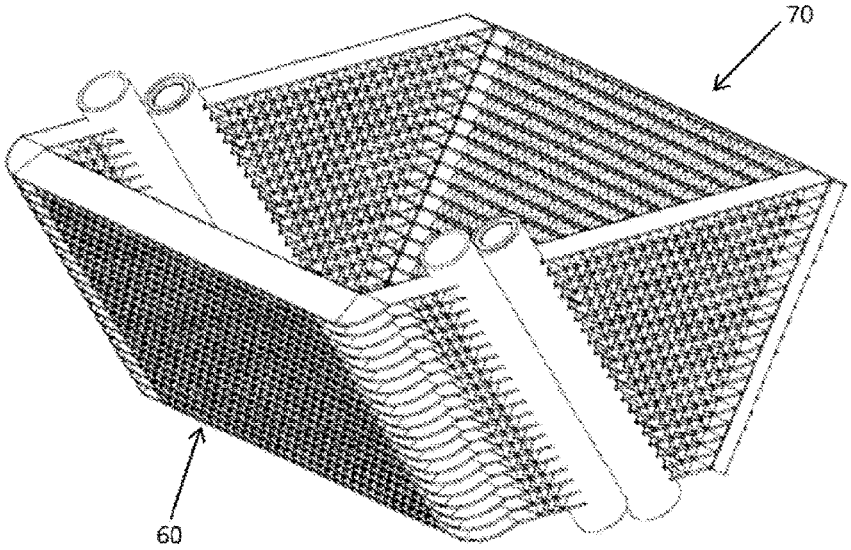
FIG. 6 is a schematic diagram of a heat exchange module according to the second embodiment of the present invention, comprising the two heat exchangers of FIG. 4 and FIG. 5.

Reference is made to FIGS. 4-6, which show a heat exchange module according to a second embodiment of the present invention; this heat exchange module is formed of two asymmetric heat exchangers 60 and 70. The heat exchanger 60 has a rectangular main body part 65 and two bent parts 66 and 67 which are substantially parallelogram-shaped. In the two bent parts 66 and 67, the lengths of the flat tubes are the same. The bending steps thereof are the same as in the first embodiment, the only difference being that two parallelogram-shaped bent parts are formed by bending. For this reason, a simple description of the bending steps is provided.

The bending steps of the heat exchanger 60 are described concisely below:

First of all, the flat tubes are bent, then a core body of the heat exchanger 60 is bent; before the core body of the heat exchanger is assembled, two sides of each flat tube must each be bent at an angle $\alpha$ using the width direction as an axis. Preferably, a is substantially equal to half of an included angle $\beta$ of a V-shape of a trapezoidal side; in the bent parts 66 and 67, each flat tube has the same length. However, for convenience of fabrication, the length of each flat tube can be adjusted slightly.

The other heat exchanger 70 has a rectangular main body part 75 and two substantially trapezoidal bent parts 76 and 77. The bending steps of the heat exchanger 70 are as follows:

First of all, the flat tubes are bent, then a core body of the heat exchanger 70 is bent; before the core body of the heat exchanger is assembled, two sides of each flat tube must each be bent at an angle $\alpha$ using the width direction as an axis. Preferably, $\alpha$ is substantially equal to half of an included angle $\beta$ of a V-shape of a trapezoidal heat exchange side; in each bent part 76 or 77, the bottommost flat tube is the shortest, the topmost flat tube is the longest, and the lengths of the flat tubes increase incrementally by 2L*tan($\alpha$) from bottom to top. In other words, in the heat exchanger 70, the length of each flat tube increases incrementally by 4L*tan($\alpha$) from bottom to top. For convenience of fabrication, the length of each flat tube can be adjusted slightly.

Figure 7:
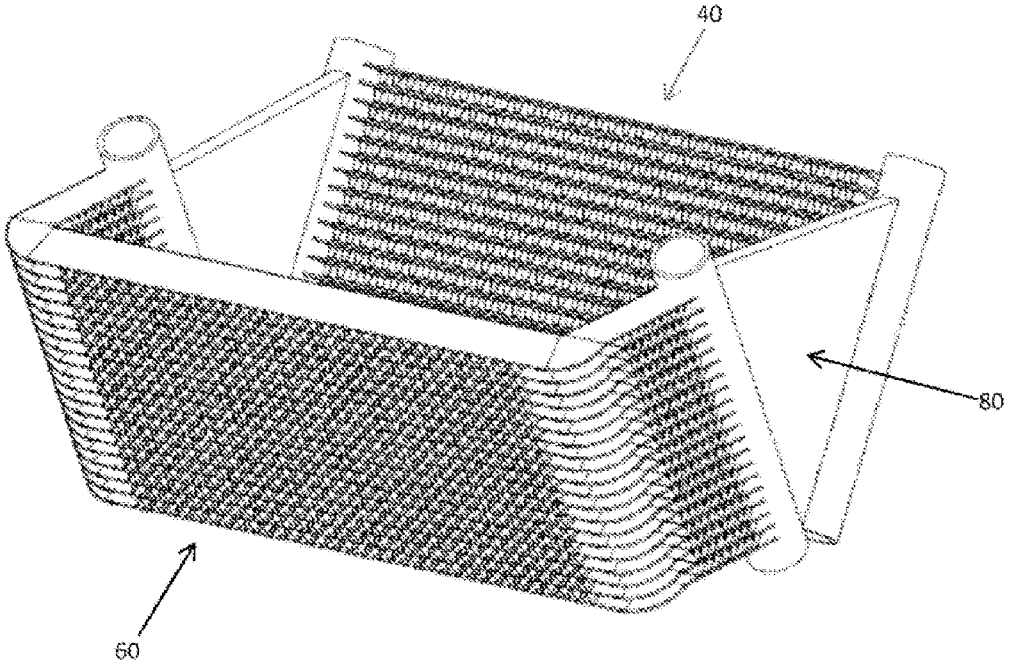
FIG. 7 is a schematic diagram of a heat exchange module according to a third embodiment of the present invention.

FIG. 7 shows a heat exchange module according to a third embodiment of the present invention. The heat exchange module comprises two asymmetric heat exchangers 60 and 40. This heat exchanger 60 is the same as the heat exchanger 60 in FIG. 6, and is therefore shown using the same reference labels (as below, so is not described again).

The other heat exchanger 40 is a conventional heat exchanger, which only has a main body part that is identical or substantially identical to the heat exchanger 60. The difference is that two ends of the rectangular main body part are each provided with a header.

It can be understood that once the heat exchangers 60 and 40 have been joined together, there will be a triangular or substantially triangular region with no heat exchange tubes or fins on each trapezoidal heat exchange side of the heat exchange module. Thus, this is called an air leakage region, and can be blocked with the air baffle plate or wind-blocking element 80 shown in FIG. 7. The specific shape of the air baffle plate 80 and the material from which it is made, etc. may be selected according to requirements, and are not described in detail here.

Figure 8:
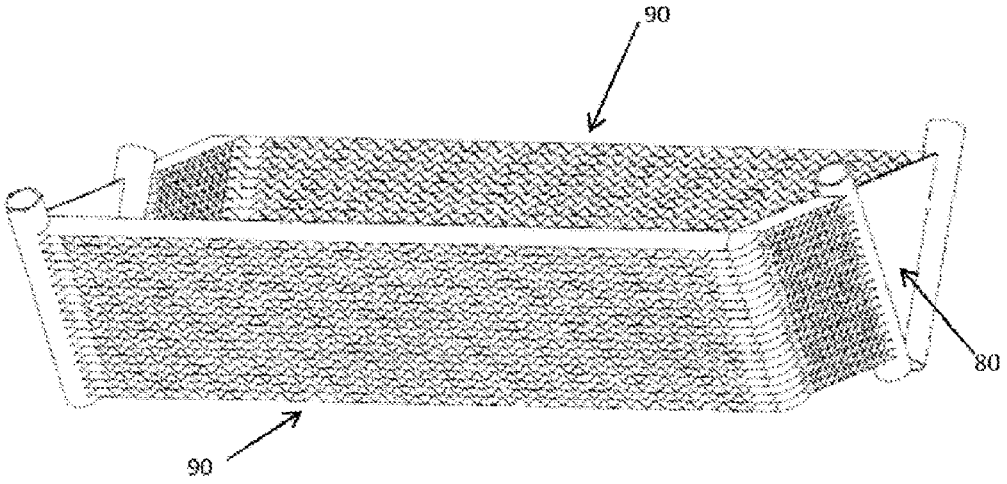
FIG. 8 is a schematic diagram of a heat exchange module according to a fourth embodiment of the present invention.

FIG. 8 shows a heat exchange module according to a fourth embodiment of the present invention. The heat exchange module comprises two symmetric heat exchangers 90. The heat exchanger 90 differs from the heat exchanger 60 in FIG. 6 only in that a bent part is provided on one side. The manner or steps of bending are the same as for the heat exchanger 60 in FIG. 6.

It can be understood that once the two heat exchangers 90 have been joined together, there will be a triangular or substantially rectangular region with no heat exchange tubes or fins on each trapezoidal heat exchange side of the heat exchange module. Thus, this is called an air leakage region, and can be blocked with the air baffle plate or wind-blocking element 80 shown in FIG. 8. The specific shape of the air baffle plate 80 and the material from which it is made, etc. may be selected according to requirements, and are not described in detail here.

Figure 9:
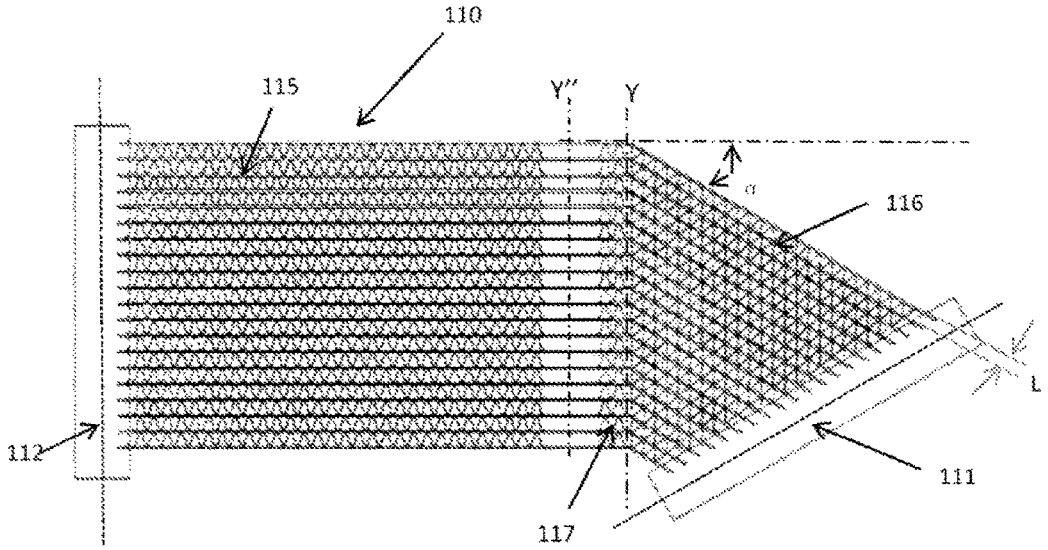
FIG. 9 is a schematic diagram of a heat exchanger according to a fifth embodiment of the present invention.
Figure 10:
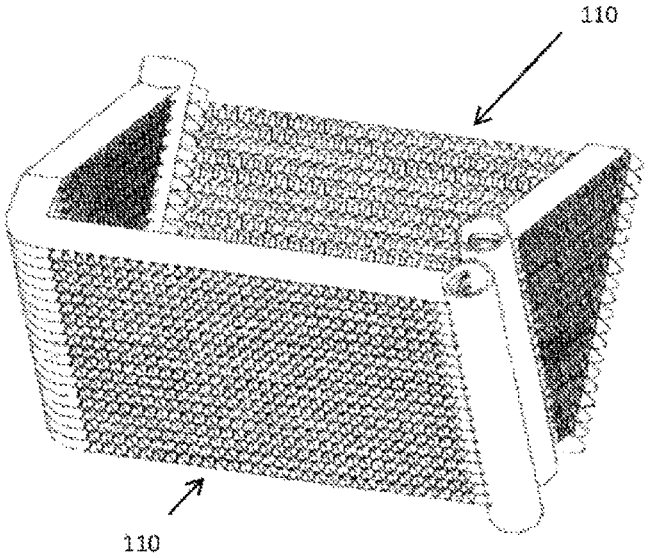
FIG. 10 is a schematic diagram according to a fifth embodiment of the present invention, comprising the heat exchanger of FIG. 9.

FIGS. 9 and 10 show a heat exchange module and a heat exchanger according to a fifth embodiment of the present invention. The heat exchange module comprises two identical heat exchangers 110. Reference is specifically made to FIG. 9, which shows the specific structure of the heat exchanger 110. Although the heat exchanger 110 has a bent part on only one side, it is formed by bending a core body of the heat exchanger 110 twice along two different bending axes Y and Y".

The specific bending steps and manner of bending are as follows:

First of all, one side of each flat tube (such as the right side of the flat tube in the drawing) is bent at an angle α using the width direction of the flat tube (i.e. the top-bottom direction in the plane of the page) as an axis, and the bent flat tubes are then inserted in sequence into slots (not shown) in headers 111 and 112 on two sides. Then by adjusting the positions of the flat tubes, it is ensured that the bending points, on the right side, of all the flat tubes are substantially on one line, i.e. on the bending axis Y shown in FIG. 9. Thus the heat exchanger 110 forms a main body part 115 and a bent part 116. Fins are inserted between adjacent flat tubes, which are then put into a brazing furnace and brazed to form a single body. Finally, the bent part 116 in the bent heat exchanger is bent along a direction substantially perpendicular to the main body part 115 using the bending axis Y as a bending axis (i.e. the body of the heat exchanger is bent); next, the bent part 116 is bent along the other bending axis Y" through a predetermined angle relative to the main body part 115, forming another bent part 117, such that the main body part 115 is perpendicular or substantially perpendicular to the bending part 116 (see FIG. 10).

The bending axis Y" may deviate from the axis Y, and may be on either side of the bending axis Y. Preferably, the distance between Y" and Y is less than or equal to 200 mm. If an air leakage region is formed when the two heat exchangers 110 are joined together, an air baffle plate may be disposed at the air leakage region.

Figure 11:
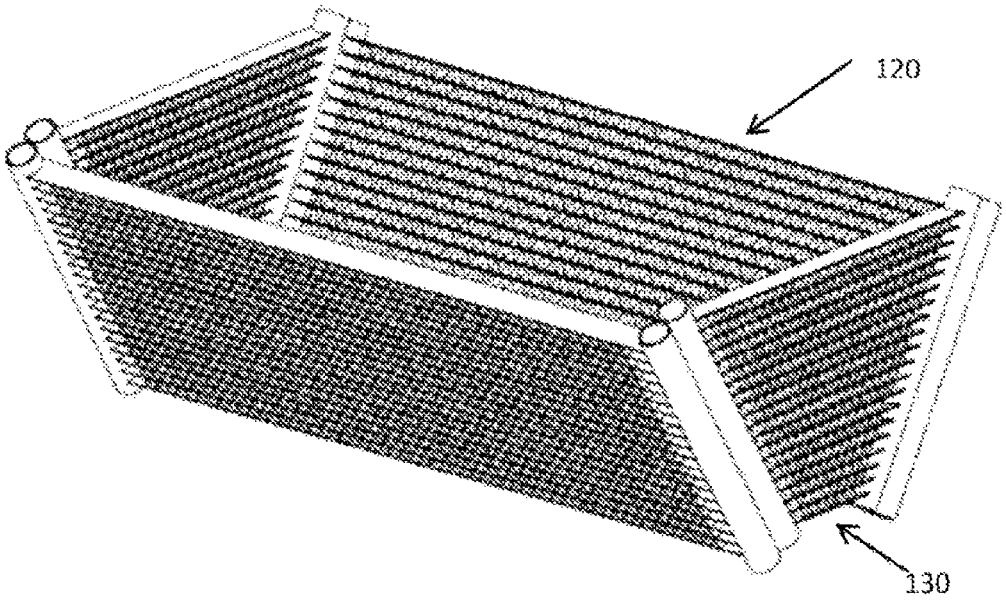
FIG. 11 is a schematic diagram of a heat exchange module according to a sixth embodiment of the present invention.

FIG. 11 shows a heat exchange module according to a sixth embodiment of the present invention. The heat exchange module is four heat exchangers 120 and 130 which are joined together.

Two heat exchangers 120 amongst the four heat exchangers have the same dimensions and substantially quadrilateral sides; the other two heat exchangers 130 amongst the four heat exchangers have the same dimensions and trapezoidal sides. Each heat exchanger 120 and 130 comprises two headers disposed on two opposite sides of the heat exchanger. Multiple heat exchange tubes are in communication with the headers (in some examples, as shown in the figure, the heat exchange tubes are in communication with the headers obliquely), and are arranged at intervals in the sides of the heat exchangers, extending substantially parallel to each other therein. The heat exchange tubes are flat tubes, on which are provided fins.

In each of the abovementioned embodiments of the present invention, first of all the flat tubes are bent at an angle α for example, then the bent flat tubes are bent relative to the main body part of the heat exchanger so as to be perpendicular to the main body part, thereby finally forming the trapezoidal sides of the heat exchange device; however, it is also possible to manufacture a heat exchanger with a similar structure in a different way. For example, a structure which is identical or similar to that of the heat exchanger of the present invention is obtained by winding the heat exchange tubes so that they continuously extend in a winding manner partially or completely between the main body part and the bent parts of the abovementioned heat exchanger. In other words, a heat exchanger similar to the present invention can be obtained by winding one or more heat exchange tubes to form a substantially U-shaped or winding structure. In feasible circumstances, such a winding method can eliminate the use of headers.

The advantage of the present invention is that it can increase the heat exchange area of the heat exchange device without increasing the size of the HVAC system. It can increase the energy efficiency of the HVAC system (decrease the power consumption) by improving the heat exchange performance of the heat exchanger. If the HVAC does not require higher energy efficiency and greater heat exchange performance, the present invention can also be used to reduce the number of heat exchangers in the system, such that the entire HVAC system is more compact, and has lower manufacturing and installation costs.

These are merely some embodiments of the present invention. Those skilled in the art will understand that changes may be made to these embodiments without departing from the principles and spirit of the overall inventive concept herein. The scope of the present invention is defined by the claims and their equivalents.

What is claimed is:

1. A heat exchanger of a heat exchange device for use on an air-cooled water chiller unit or commercial rooftop machine, wherein the heat exchanger comprises:

a main body part, having a quadrilateral side;

at least one bent part connected to the main body part, with one of the at least one bent part having a parallelogram-shaped side;

at least one heat exchange tube, extending between the main body part and the bent part, wherein a heat exchange tube in the bent part is inclined and bent relative to a heat exchange tube in the main body part, such that a first plane in which the main body part lies is perpendicular to a second plane in which the bent part lies;

wherein the at least one bent part is two bent parts, one of the two bent parts having a parallelogram-shaped side, and the other bent part having a trapezoidal side;

wherein two sides of the heat exchange tube are each bent at an angle α using a width direction as an axis, with a bending point on each side of the heat exchange tube lying on a first bending axis, and the heat exchange tube being bent at an angle β along the first bending axis; and wherein β is the included angle between two non-parallel sides of the trapezoidal side, the angle α is in the range of β/2−5° to β/2+5°, and when a short edge of the trapezoidal side is located at the bottom, the length of each heat exchange tube increases incrementally by 2L*tan(α) from bottom to top, wherein the distance between heat exchange tubes in the bent part is L.

2. The heat exchanger as claimed in claim 1, wherein the at least one bent part is two bent parts which both have a parallelogram-shaped side.

3. The heat exchanger as claimed in claim 2, wherein two sides of the heat exchange tube are each bent using a width direction as an axis, with a bending point on each side of the heat exchange tube lying on a first bending axis, and the heat exchange tube being bent along the first bending axis.

4. The heat exchanger as claimed in claim 1, wherein one side of the heat exchange tube is bent using a width direction as an axis, with a bending point on this side of the heat exchange tube lying on a first bending axis, and the heat exchange tube being bent along the first bending axis.

5. A heat exchanger of a heat exchange device for use on an air-cooled water chiller unit or commercial rooftop machine, wherein the heat exchanger comprises:

a main body part, having a quadrilateral side;

two bent parts connected to the main body part, each of the two bent parts having a trapezoidal side;

at least one heat exchange tube, extending between the main body part and the bent parts, wherein a heat exchange tube in the bent part is inclined and bent relative to a heat exchange tube in the main body part, such that a first plane in which the main body part lies is perpendicular to second and third planes in which each of the two bent parts lies, respectively;

wherein two sides of the heat exchange tube are each bent at an angle α using a width direction as an axis, with a bending point on each side of the heat exchange tube lying on a first bending axis, and the heat exchange tube being bent at an angle β along the first bending axis; and wherein β is the included angle between two non-parallel sides of the trapezoidal side, the angle α is in the range of β/2−5° to β/2+5°, and when a short edge of the trapezoidal side is located at the bottom, the length of each heat exchange tube increases incrementally by 4L*tan(α) from bottom to top, wherein the distance between heat exchange tubes in the bent part is L.

6. A heat exchanger of a heat exchange device for use on an air-cooled water chiller unit or commercial rooftop machine, wherein the heat exchanger comprises:

a main body part;

a bent part connected to the main body part, the bent part being only one bent part, and the bent part having a bent trapezoidal side;

at least one heat exchange tube, extending between the main body part and the bent part, wherein a heat exchange tube in the bent part is inclined and bent relative to a heat exchange tube in the main body part, such that a first plane in which the main body part lies is perpendicular to a second plane in which the bent part lies;

wherein one side of the heat exchange tube is bent at an angle α using a width direction as an axis, with a bending point on this side of the heat exchange tube lying on a first bending axis, the bent heat exchange tube is bent at an angle β along a second bending axis that is different from the first bending axis, wherein β is the included angle between two non-parallel sides of the trapezoidal side, the angle α is in the range of β/2−5° to β/2+5°, and when a short edge of the trapezoidal side is located at the bottom, the length of each heat exchange tube increases incrementally by 2L*tan(α) from bottom to top, wherein the distance between heat exchange tubes in the bent part is L.

7. The heat exchanger as claimed in claim 6, wherein the distance between the first bending axis and second bending axis is less than or equal to 200 mm.

8. The heat exchanger as claimed in claim 1, wherein also comprising two headers disposed on two opposite sides of the heat exchanger, wherein the heat exchange tube is multiple heat exchange tubes, which are arranged at intervals in the main body part and bent part and extend parallel to each other in the main body part and bent part;

each of the heat exchange tubes extends from one of the two headers to the other header through the bent part and main body part.

9. The heat exchanger as claimed in claim 8, wherein the heat exchange tubes are flat tubes, and fins are disposed on those parts of the flat tubes which are not bending points, with ends of the flat tubes being in perpendicular communication with the headers.

10. A heat exchange module of a heat exchange device for use on an air-cooled water chiller unit or commercial rooftop machine, said heat exchange module comprising two identical and matching heat exchangers which are joined together, wherein each heat exchanger is the heat exchanger as claimed in claim 1.

11. A heat exchange module of a heat exchange device for use on an air-cooled water chiller unit or commercial rooftop machine, said heat exchange module comprising two different but matching heat exchangers, one of these heat exchangers being the heat exchanger as claimed in claim 6, and the other of these heat exchangers being the heat exchanger comprising:

a main body part, having a quadrilateral side;

two bent parts being connected to the main body part, with one of the two bent parts having a parallelogram-shaped side;

at least one heat exchange tube, extending between the main body part and one bent part of the two parts, wherein a heat exchange tube in the one bent part is inclined and bent relative to a heat exchange tube in the main body part, such that a first plane in which the main body part lies is perpendicular to a second plane in which the one bent part lies, and wherein the two bent parts both have a parallelogram-shaped side.

12. A heat exchange module of a heat exchange device for use on an air-cooled water chiller unit or commercial rooftop machine, said heat exchange module comprising two different but matching heat exchangers, one of these two heat exchangers being the heat exchanger as claimed in claim 2, and the other of these two heat exchangers only having a main body part having a parallelogram-shaped side.

13. The heat exchange module as claimed in claim 12, wherein an air leakage region formed when the two heat exchangers are joined together is provided with an air baffle plate.

14. A heat exchange module of a heat exchange device for use on an air-cooled water chiller unit or commercial rooftop machine, said heat exchange module comprising two identical and matching heat exchangers, each of these two heat exchangers being the heat exchanger as claimed in claim 4.

15. The heat exchange module as claimed in claim 14, wherein an air leakage region formed when the two heat exchangers are joined together is provided with an air baffle plate.

16. A heat exchange module of a heat exchange device for use on an air-cooled water chiller unit or commercial rooftop machine, said heat exchange module comprising two identical and matching heat exchangers, each of these two heat exchangers being the heat exchanger as claimed in claim 6.

17. The heat exchange module as claimed in claim 16, wherein an air leakage region formed when the two heat exchangers are joined together is provided with an air baffle plate.

18. A heat exchange module of a heat exchange device for use on an air-cooled water chiller unit or commercial rooftop machine, said heat exchange module comprising:

four heat exchangers joined together, wherein two of the four heat exchangers have the same dimensions and quadrilateral sides, the other two of the four heat exchangers have the same dimensions and trapezoidal sides, wherein each heat exchanger comprises two headers, a first header of the two headers disposed on a first side of the heat exchanger and a second header of the two headers disposed on a second side of the heat exchanger, the second side being opposite and non-adjacent to the first side of the heat exchanger, wherein each heat exchanger comprises multiple heat exchange tubes in communication with the two headers of the respective heat exchanger, and are arranged at intervals in the sides of the heat exchangers, extending parallel to each other therein.

19. The heat exchange module as claimed in claim 18, wherein:

the heat exchange tubes are flat tubes, on which are provided fins.

20. A heat exchange device for use on an air-cooled water chiller unit or commercial rooftop machine, the heat exchange device comprising at least one heat exchange module which is the heat exchange module as claimed in claim 10.

21. A heat source unit, the heat source unit also comprising, in cooperation with each other, a heat exchange device, a blower, a water drainage plate in communication with the heat exchange device, and a machine room which houses cooling cycle constituent parts other than the heat exchange device, wherein the heat exchange device is the heat exchange device as claimed in claim 20.

22. The heat exchange module as claimed in claim 18, wherein the multiple heat exchange tubes of each heat exchanger extend in a horizontal direction.

23. The heat exchange module as claimed in claim 18, wherein the four heat exchangers joined together form four corners, and wherein at each corner of the four corners a header of the two headers of each heat exchanger of the four heat exchangers is connected to a header of the two headers of another heat exchanger of the four heat exchangers.

24. The heat exchange module as claimed in claim 18, wherein a heat exchanger of the two heat exchangers having trapezoidal sides is arranged perpendicular to both of the two heat exchangers having quadrilateral sides.

* * * * *